United States Patent [19]

Ballard

[11] 4,133,340

[45] Jan. 9, 1979

[54] CLEANING MACHINE FOR SIMULTANEOUSLY CLEANING THE INTERIOR AND EXTERIOR OF HOLLOW ARTICLES

[76] Inventor: Thomas B. Ballard, 25550 Mulberry Dr., Southfield, Mich. 48075

[21] Appl. No.: 788,295

[22] Filed: Apr. 18, 1977

[51] Int. Cl.[2] ..... B08B 3/02; B08B 9/08

[52] U.S. Cl. ..... 134/112; 134/114; 134/139; 134/143; 134/148; 134/152; 134/170; 134/200

[58] Field of Search ..... 134/112, 114, 138–139, 134/141, 143, 148–149, 152–153, 170, 173–174, 191, 199–200

[56] References Cited

U.S. PATENT DOCUMENTS

| | | | |
|---|---|---|---|
| 1,051,669 | 1/1913 | Boesser | 134/138 |
| 2,228,684 | 1/1941 | Barnum | 134/152 X |
| 2,764,171 | 9/1956 | Nolte | 134/153 X |
| 3,452,763 | 7/1969 | Ballard | 134/139 X |
| 3,656,491 | 4/1972 | Ballard | 134/139 X |

FOREIGN PATENT DOCUMENTS

| | | | |
|---|---|---|---|
| 712920 | 10/1941 | Fed. Rep. of Germany | 134/138 |

*Primary Examiner*—Robert L. Bleutge
*Attorney, Agent, or Firm*—Krass & Young

[57] ABSTRACT

A cleaning machine of the type in which a cleaning fluid spray is directed at an article supported in the interior of a machine cabinet structure and rotated while being sprayed by a plurality of cleaning fluid jets. The cleaning machine disclosed includes a central spray pipe, extending through an article supporting rotary table and adapted to spray the interior of the workpiece simultaneously with the directing of cleaning fluid spray at the exterior of the part, to clean the interior and the exterior of the article simultaneously. The rotary table is adapted to be supported on a bearing assembly, carried by the central spray pipe, the bearing assembly functioning both as the rotational support for the rotary table and also acting to form a fluid coupling between the central spray pipe and cleaning fluid distribution manifolding disposed beneath the rotary table. The bearing assembly is designed to be protected both from runoff from the cleaning fluid spray and also the cleaning fluid contained in the machine sump, the bearing assembly extending beneath the level of the cleaning fluid in the sump. The bearing assembly also allows easy removal of the rotary table without disturbing the bearings or the central spray pipe. In addition, the machine cabinet structure is configured to allow raising of the entire upper cabinet structure away from the sump cabinet and with it the manifolding, the rotary table, an electric pump and motor assembly used to circulate the cleaning fluid, this allowing easy access to the machine sump for clean-out purposes.

12 Claims, 4 Drawing Figures

CLEANING MACHINE FOR SIMULTANEOUSLY CLEANING THE INTERIOR AND EXTERIOR OF HOLLOW ARTICLES

BACKGROUND OF THE INVENTION

1. Field of the Invention

This invention concerns cleaning machines and more particularly machines adapted to cleaning machine parts and similar articles by directing a cleaning fluid spray at the article while the article is being rotated on a rotary table or some other such support.

2. Description of the Prior Art

Cleaning machines of the spray type disclosed in U.S. Pat. Nos. 3,422,826 and 3,452,763 have enjoyed considerable success in applications such as the cleaning of engine blocks and transmission housings. These machines involve the support of a part within an insulated cabinet on a rotary table with a series of spray pipes extending about the periphery of the rotary table and adapted to direct numerous jets of cleaning fluid at the article as it rotates, thereby completely and thoroughly cleaning the exterior of the article. In these machines there is a sump or reservoir cabinet portion and an electric pump and motor combination which circulates the cleaning solution through a manifolding and thence to the spray pipes.

Although highly successful for most article configurations, it would be advantageous if it would be possible to be able to clean simultaneously the interior and the exterior of parts such as transmission housings, which have large interior cavities which are relatively inaccessible by the cleaning fluid spray from the exterior thereof.

After extended use of these cleaning machines, it generally becomes necessary to pump out the sump cavity within the cabinetry for cleaning purposes, inasmuch as the dissolved grease and dirt and other solid materials collect in the sump, requiring periodic cleanout. It would, of course, be desirable to have relatively easy access thereto free of such equipment such as pumps and support structure for the rotary table, etc.

The rotary table has generally in the past been supported by means of permanently affixed structural members supporting a bearing assembly through which is affixed a central support shaft. Typically in these machines the rotary table is adapted to be rotated by means of a jet or jets directed at a plurality of turbine vanes disposed about the exterior of the table with a rotational speed limiting paddles extending down into the cleaning fluid contained in the sump. This environment has a tendency to have a deleterious effect on the bearing life, inasmuch as the cleaning solutions are typically water based.

Furthermore, the structural arrangement has rendered it difficult to gain access to the cleaning fluid reservoir or sump, since the rotary table remains in the way even if the cabinetry is configured to be opened to gain access to the sump.

Furthermore, removal of the rotary table for replacement with workpiece support tables of various configurations becomes a rather burdensome procedure since the bearing assembly, etc., must be completely disassembled.

It is therefore an object of the present invention to provide a capability for such machines for directing cleaning fluid spray at both the interior and the exterior of workpieces having hollow central cavities.

It is a further object of the present invention to provide a support for the rotary tables included in such machines which does not preclude free access to the sump region of the machine cabinet.

It is a further object of the present invention to provide a bearing support for such rotary table that is protected from the corrosive effects of the cleaning fluid runoff from the work part, and also from the cleaning fluid contained in the sump region of the machine cabinet.

It is yet another object of the present invention to provide a rotary table support arrangement which allows easy removal of the rotary table with a minimum of disassembly of the machine required.

SUMMARY OF THE INVENTION

These and other objects which will become apparent upon a reading of the following specification and claims is accomplished by fluid spray cleaning machine of the type described in which a central stationary spray pipe is provided, extending upwardly through the center portion of the rotary table, having a series of jet openings adapted to direct jets of cleaning fluid into the interior of a hollow article supported on the rotary work table with the central spray pipe extending into the interior portion of the interior cavity of the article. The rotary table is adapted to be supported for rotation on a bearing assembly, acting both as a fluid coupling between the central spray pipe and a manifolding assembly disposed beneath the rotary table, as well as a rotary bearing support for the rotary table. The rotary bearing arrangement includes a plurality of nested protective oppositely directed shielding sleeve and cup assemblies which isolate a central rotary bearing set, through which extends a fluid coupling by means of which the cleaning solution is supplied to the central spray pipe. The nested shielding sleeves and cup element provide a lubricant reservoir and cleaning fluid shield, such as to effectively protect the bearings from the corrosive effects of the cleaning solution, even though the bearing set extends below the level of cleaning solution contained within the sump of the machine. The rotary bearing assembly and shielding sleeves and cup element are disposed such that the rotary table may be lifted from the central spray pipe without disturbing the bearing set and allowing the lubricant reservoir to remain undisturbed. The manifolding assembly is supported on the midsection of the machine cabinetry which is adapted to be pivoted away from a lower section of the cabinetry defining a sump cavity such that the entire assembly may be moved clear of the sump for easy access of the interior thereof for cleanout purposes.

DETAILED DESCRIPTION

In the following specification certain specific terminology will be utilized for the sake of clarity and particular embodiment described in accordance with the requirements of 35 USC 112, but it should be understood that the same is not intended to be limiting and should not be so construed, inasmuch as the invention is capable of taking many forms and variations within the scope of the appended claims.

Figure 1:
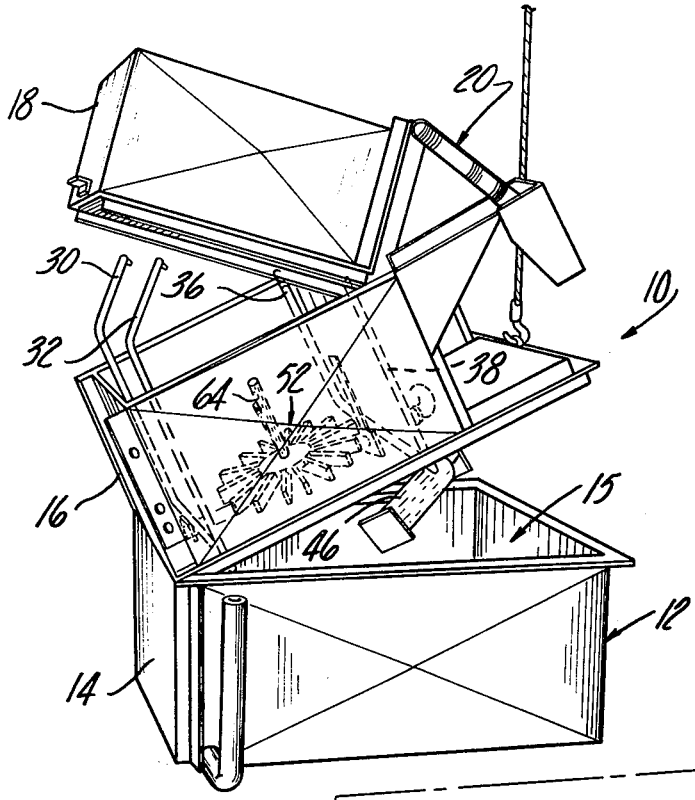
FIG. 1 is a perspective view of a cleaning machine according to the present invention, with certain of the details thereof omitted for the sake of clarity, with the various sections of the machine cabinetry being shown in the raised position relative to each other.

Referring to the drawings, the cleaning machine according to the present invention includes a cabinet structure 12 divided into three sections, a lower unit 14 which provides a sump reservoir for containment of the cleaning solution, a mid-section 16 adapted to house the cleaning mechanism to be described hereon and an upper or lid section 18, adapted to close off the space within the mid-section 16. Each of these sections, 14, 16 and 18, is pivoted with respect to the section adjacent thereto and in opposite directions as shown in FIG. 1, so as to be rotated relative to each other in opposite directions, as shown in FIG. 1. In normal use the lower section 14 and the mid-section 16 remain one on top of the other with the upper or lid section 18 raised in order to place articles within the interior section 16 for cleaning.

Thus the upper section 18 is counter-sprung by means of coil springs 20 so as to allow easy manual opening of the lid and access to the interior of mid-section 16.

The details of the counter-spring 20 are described in the aforementioned U.S. Pat. No. 3,452,763 and accordingly details thereof will not be herein described.

Whenever it becomes necessary to clean the sump or lower unit 14, the mid-section 16 is adapted to be raised by means of a hoist as shown in FIG. 1 to provide access thereto, the entire cleaning mechanism mounted to and being carried with the mid-section 16 to provide completely unobstructed access to the sump by means of the mounting arrangement to be described therein.

The cleaning mechanism contained within the machine 10 includes a manifolding assembly 22 comprised of a horizontally extending distributor fluid conduit 24 to which are welded a pair of cross fluid conduits 26 and 28. The interior of the respective fluid conduits, 24, 26 and 28, being in fluid communication. The fluid conduit 26 terminates at each end in a pair of vertically extending spray pipes, 30 and 32, angled at their upper ends and provided with jet nozzles, 32 and 34, adapted to direct cleaning fluid downwardly.

The other fluid conduit 28 terminates in a pair of vertically extending spray pipes, 36 and 38, each of these conduits having a plurality of jet openings formed throughout their length, such as to distribute a spray towards the interior of the machine cabinet 12.

Figure 3:
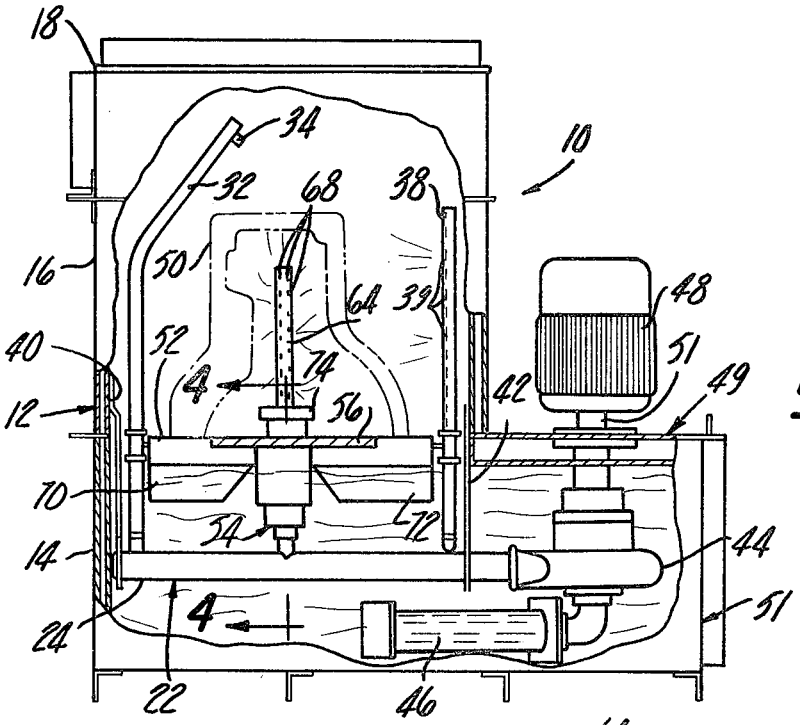
FIG. 3 is a front elevational view of the cleaning machine according to the present invention in partial section.

The manifold assembly 22 is adaptably supported by the cabinet mid-section 16 by means of a pair of hanger straps, 40 and 42, secured to the central distributor fluid conduit 24 at one end and welded to an interior partition of the cabinet mid-section 16, as shown in FIG. 3. The distributor fluid conduit is connected at its other end to means for circulating the cleaning fluid, here taking the form of a circulation pump 44 which receives an inlet flow through a filter 46 and its outlet and fluid communication with the horizontal distributor fluid conduit 24. An electric pump motor 48 is located exterially of the machine cabinet structure 12 on a lateral extension 49 formed on the cabinet mid-section 16 and overlaying a similar extension 51 formed on the cabinet lower section 14. The electric pump motor 48 has an output shaft 51 coupled to the impeller of the pump 44, as shown in FIG. 3.

The article to be cleaned, depicted in phantom in FIG. 3 as a transmission housing 50, is adapted to be supported on a rotary table 52 which rotary table is supported on the horizontal distributor fluid conduit 24 by means of a bearing-fluid coupling assembly 54, to be described hereinafter in detail. The rotary table 52 is formed by a central hub 56, to which are welded a series of radially extending paddle wheels 58. The paddles 58 provide the reaction surfaces for a pair of nozzles, 60 and 62, which are adapted to direct a jet of cleaning fluid at the paddles 58, so as to cause the table to be rotated during circulation of the cleaning fluid by the circulation pump 44.

Extending through the center of the rotary table 52, is a vertically extending central stationary spray pipe 64, which is formed with a plurality of orifices 66 throughout its length, so as to be adapted to direct a spray at the interior of the article 50, supported on the rotary table 52, as the article 50 rotates thereon, while simultaneously flow directed through the jets 32 and 34 and from orifices 39 in spray pipes 36 and 38 completely scour the exterior of the part.

Figure 2:
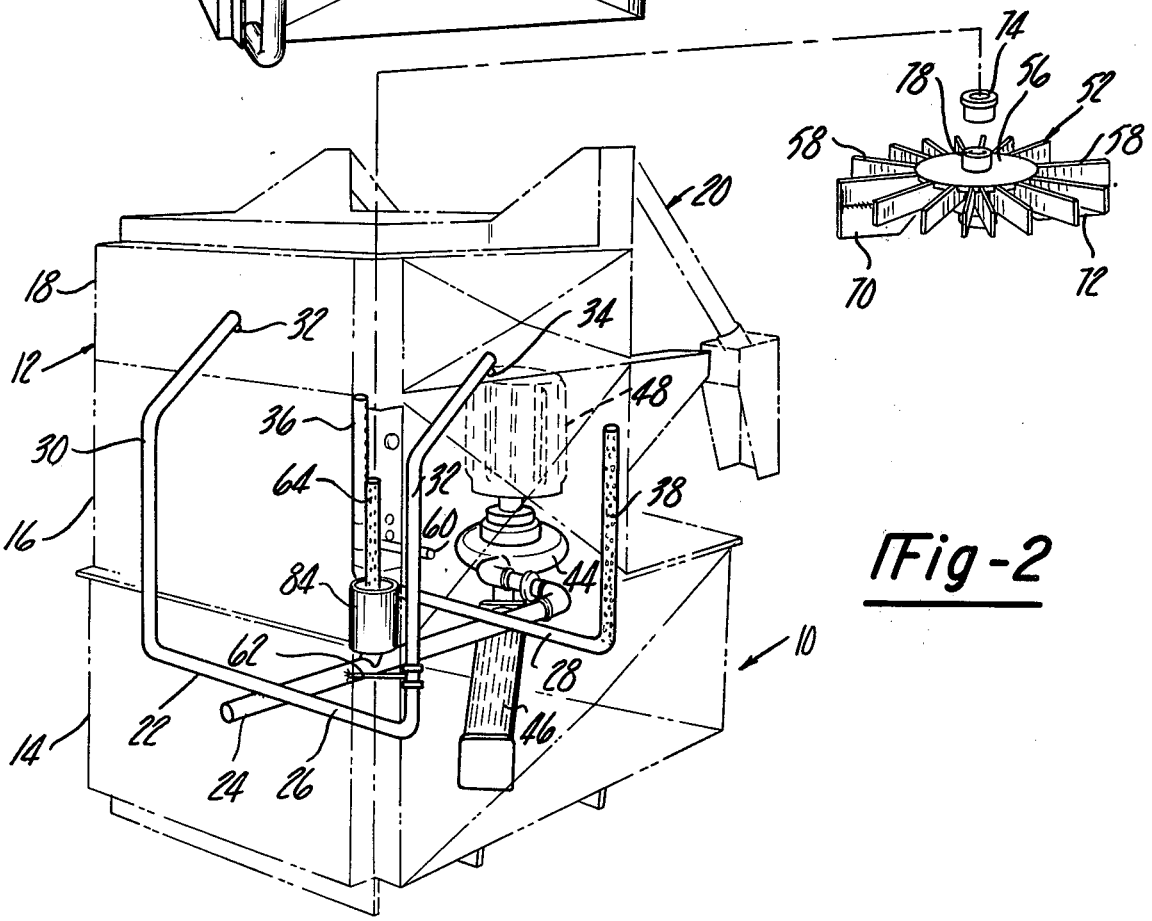
FIG. 2 is another perspective view of a cleaning machine, according to the present invention with the cabinetry portion shown in phantom depicting the interior manifolding and with the rotary table exploded from the bearing assembly.

A pair of paddle extensions 70 and 72 are provided on oppositely positioned paddles 58, as shown in FIGS. 2 and 3, which extend beneath the level of cleaning fluid in the sump 15, as shown in FIG. 3. These have a tendency to create drag as the rotary table 52 is rotated to control the rotational velocity of the rotary table 52 at a relatively slow continuous rate.

Figure 4:
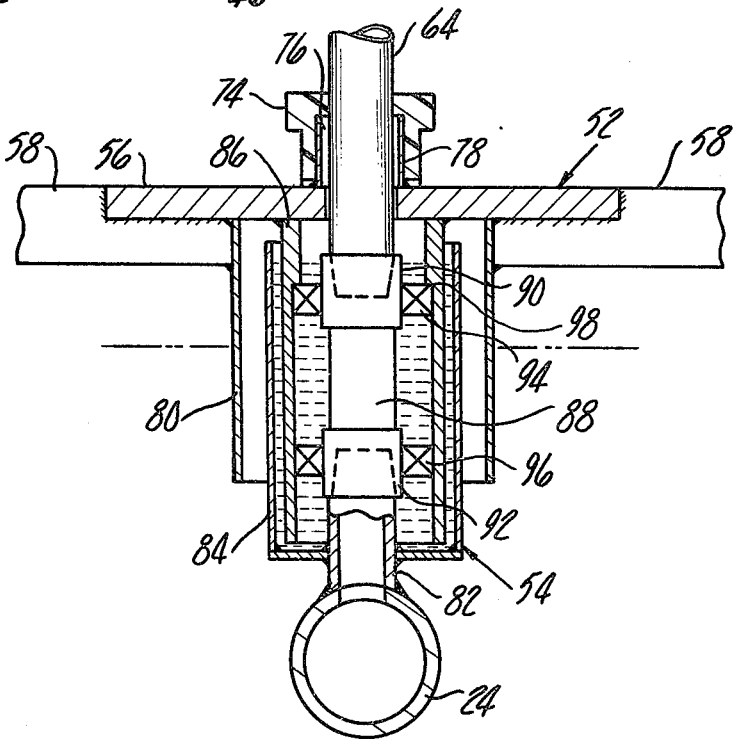
FIG. 4 is a view of the section 4—4 taken in FIG. 3, depicting the details of the rotary work table, rotary bearing and fluid coupling assembly.

The rotary table 52 is retained on the spray pipe 68 by virtue of a plastic retainer 74, press fitted over the O.D. of the stand pipe 68 and having a recess 76, which in turn is press fit over a cylindrical liner sleeve 78, welded to the surface of the hub 56, as shown in FIG. 4, thus providing secure retention of the rotary table 52, while effectively sealing the opening through which the central spray pipe 64 passes.

The rotary table 52 also includes a downwardly directed shielding sleeve 80 welded to the hub 56, as well as the individual radial paddles 58, as also shown in FIG. 4, the shielding sleeve 80 surrounding the bearing-fluid coupling assembly 54. The bearing-fluid coupling assembly 54 includes a pipe nipple 82, welded to the horizontal distributor fluid conduit 24 and being in internal communication therewith. The pipe nipple 82 passes into an upwardly directed cup shaped element 84 which receives in its interior a downwardly directed sleeve 86 welded about its periphery to the central hub 56. Within the interior of the downwardly extending sleeve 86 and surrounded thereby is a central member comprised of a coupling assembly 88, in turn comprised of a pair of pipe couplings 90 and 92 threaded to opposite ends of a central pipe nipple 88. Coupling 92 is threaded into the upwardly extending end of pipe nipple 82 while the central spray pipe 64 is threaded into the coupling 90. Both couplings 90 and 92 have press fitted on the O.D. thereof a thrust-radial bearing, 94 and 96 respectively, bearing 94 being received against a shoulder 98 so as to absorb the weight of the rotary table 52. The cavity within the cup-shaped element 84 is filled with a lubricant such as oil as shown in FIG. 4, so as to completely immerse the bearings therein and prevent the entrance of cleaning fluid, etc. The shielding sleeve 80 on the other hand provides an air lock isolation of the interior open end of bearing 84 such that the entrance of cleaning solution is essentially prevented.

By simply removing the plastic retainer 74 the rotary table 52 may be easily removed by being drawn upwardly over the central stand pipe 64, leaving the bearing set intact and with no further disassembly required. Similarly, the entire assembly can be raised together with the central cabinet section 16 for cleaning of the sump and the entire assembly will thereby be removed to provide easy access to the sump 15.

In operation a part would be placed over the central spray pipe 64, as shown in FIG. 3, and the motor 48 energized to circulate the fluid through the horizontal distributor fluid conduit 24 thence into the spray pipes, 30, 32, 36, 38, and 64, directing a powerful spray of cleaning solution at the interior and exterior of the article 50, simultaneously, while the jets, 60 and 62, directing flow at the paddles 58, cause the rotary table 52 to rotate to insure complete cleaning of every nook and cranny of the article.

It can thus be appreciated that the objects of the present invention have been accomplished, since both the interior and the exterior of the workpiece can be cleaned simultaneously and very effectively. Furthermore, the structural support for the rotary table is provided entirely by the manifolding assembly which is in turn supported in the cabinet mid-section, such that structural simplicity is achieved and at the same time the pivoting of the cabinet allows the entire assembly to be moved out of the way when the sump is required to be cleaned. The bearing assembly provides both a fluid coupling connection for the central stand pipe and also a rotary support for the rotary table, which bearing assembly is very effectively protected from the corrosive effects of the cleaning solution while at the same time allowing very simple disassembly of the rotary table from the machine. All this has been achieved by relatively simple structure without sacrificing other important design criteria.

The embodiments of the invention in which an exclusive property or privilege is claimed are defined as follows:

1. A cleaning machine comprising: a machine cabinet including reservoir means for containing a quantity of a cleaning fluid; a manifold assembly and means for circulating a cleaning fluid into said manifold assembly; a plurality of spray pipes in fluid communication with said manifold assembly and adapted to receive cleaning fluid therefrom under pressure; said plurality of spray pipes including at least two spray pipes; a rotary table rotatably supported on one of said at least two spray pipes, said one spray pipe centrally located in said cabinet and extending vertically, said manifold assembly including a horizontally extending central distribution fluid conduit, and further including means providing a fluid coupling between said one spray pipe upon which said rotary table is supported and said horizontally extending fluid conduit; means for rotating said table on said one spray pipe, including rotary bearing means, carried by said fluid coupling; a downwardly directed sleeve received over the outside diameter of said rotary bearing means, said rotary bearing means being secured on their inside diameter to said fluid coupling means; an upwardly extending cup element positioned to surround said downwardly extending sleeve to provide a lubricant reservoir with a quantity of lubricant disposed in said lubricant reservoir; each of said plurality of spray pipes including jet openings adapted to direct a spray of cleaning fluid onto surfaces of an article disposed on said rotary table; whereby said part may be cleaned by a circulation of the cleaning fluid through said manifold assembly into said plurality of spray pipes and sprayed through said jet openings.

2. The cleaning machine according to claim 1, wherein said plurality of spray pipes includes a plurality of vertically extending spray pipes, disposed about the periphery of said rotary table.

3. The cleaning machine according to claim 1 wherein said means for rotating said rotary table comprises fluid reaction surfaces, formed on said rotary table and means for directing a jet of cleaning fluid at said reaction surfaces so as to cause said rotary table to rotate.

4. The cleaning machine, according to claim 1, further including a nipple element, secured to said horizontally extending fluid conduit, extending through an end wall of said upwardly extending cup element and connected to and in fluid communication with said fluid coupling means.

5. The cleaning machine, according to claim 4, wherein said central spray pipe, upon which said rotary table supported is connected to said fluid coupling and extends through said rotary table surface and further including a retaining element, press fitted over said central spray pipe.

6. The cleaning machine, according to claim 5, further including a shielding sleeve, secured to the upper surface of said rotary table and received within a recess of said retaining element, whereby said opening in said rotary table through which said central spray pipe upon which said rotary table is rotatably supported is sealed.

7. The cleaning machine, according to claim 6, further including an outer shielding member, secured to said rotary table and adapted to extend downwardly and surround the upper portion of said cup-shaped element.

8. The cleaning machine, according to claim 1, wherein said machine cabinet is comprised of three individual cabinet sections, the lower section defining said sump, a mid-section, and an upper section adapted to close an upper opening in said mid-section of said cleaning machine cabinet; each of said sections adapted to be pivoted along one side relative each other, whereby said adjacent individual sections may be rotated away from each other.

9. The cleaning machine, according to claim 8, further including means supporting said manifold assembly on said mid-section, whereby said manifold assembly may be moved upwardly upon rotation of said mid-section.

10. The cleaning machine, according to claim 9, wherein said manifold assembly is disposed within the interior of said lower section when said mid-section is disposed in adjacent said lower section, and upon rotation of said mid-section moves out of the interior thereof whereby said reservoir section access is provided.

11. The cleaning machine, according to claim 10, wherein said means for circulating said cleaning fluid into said manifold assembly comprises a pump and motor assembly, secured thereto and adapted to be moved upwardly, together with said manifold assembly upon rotation of said central section above said pivotal connection.

12. The cleaning machine, according to claim 11, wherein said motor is disposed exteriorally of said central section and supported with a lateral extension of said mid-section cabinet.

* * * * *